United States Patent [19]

Kalmar

[11] 4,444,258

[45] Apr. 24, 1984

[54] IN SITU RECOVERY OF OIL FROM OIL SHALE

[76] Inventor: Nicholas Kalmar, 637 Arlington Ave., Berkeley, Calif. 94707

[21] Appl. No.: 319,926

[22] Filed: Nov. 10, 1981

[51] Int. Cl.[3] ..... E21B 43/243; E21B 43/30; E21B 43/40

[52] U.S. Cl. ..... 166/261; 166/245; 166/267; 166/292

[58] Field of Search ..... 166/259, 261, 256, 245, 166/292, 251, 288, 267, 266; 299/2, 11, 13

[56] References Cited

U.S. PATENT DOCUMENTS

| | | | |
|---|---|---|---|
| 2,917,296 | 12/1959 | Prentiss | 166/259 X |
| 3,126,955 | 3/1964 | Trantham et al. | 166/259 X |
| 3,149,670 | 9/1964 | Grant | 166/259 |
| 3,223,158 | 12/1965 | Baker | 166/259 |
| 3,228,468 | 1/1966 | Nichols | 166/259 |
| 4,148,358 | 4/1979 | Compton | 166/259 X |
| 4,156,461 | 5/1979 | Cha | 166/259 X |
| 4,178,039 | 12/1979 | Burton | 166/259 X |
| 4,192,381 | 3/1980 | Cha | 166/259 X |

*Primary Examiner*—Stephen J. Novosad
*Attorney, Agent, or Firm*—Owen, Wickersham & Erickson

[57] ABSTRACT

A method for in situ recovery of oil from oil shale containing oil bearing compound. The method begins with thermally decomposing the kerogen underground to produce oil vapors, combustible gases, and carbon residue, followed by conducting the oil vapors and combustible gases to aboveground and recovering it there. Next comes the steps of burning the carbon residue underground at a controlled rate such that the temperature of the formation remains below the softening temperature of the spent shale and at controlled oxidation so that carbon monoxide is produced and of conducting the carbon monoxide to aboveground and recovering it. After the burning step has been completed comes the steps of injecting water in the form of liquid, vapor, mist or steam into the hot formation to produce steam at high temperature, and conducting the high temperature steam aboveground and recovering it there. Optionally, there is the step of returning exhaust gases containing carbon dioxide and sulfur oxides into the formation and reacting them there with the alkaline earth oxides and hydroxides in the formation to produce carbonates and sulfates, thereby stabilizing the formation and strengthening it. In this step the waste gases are also purified by the removal of their sulfur oxide content and part of their carbon dioxide content.

15 Claims, 3 Drawing Figures

IN SITU RECOVERY OF OIL FROM OIL SHALE

BACKGROUND OF THE INVENTION

This invention relates to a process for recovering, in situ, oil from an oil shale deposit.

Oil shale deposits in Colorado and Wyoming have been well known for over fifty years. The Green River Formation, covering an area of approximately seventeen thousand square miles in south-western Wyoming, north-eastern Utah, and north-western Colorado, has oil shale deposits with total oil resources estimated to be eight trillion barrels of oil, in oil shales containing over ten gallons of oil per ton. The Piceance Creek Basin alone, in Colorado, has deposits containing 1.2 trillion barrels of oil in oil shales having oil content of over fifteen gallons per ton. The amount of oil in this formation alone is suifficient to supply the United States with oil for approximately one hundred ninety years, assuming a consumption of seventeen million barrels per day.

However, recovery of the petroleum from these enormous deposits has never been economical. Even after the huge recent increases in oil prices on the world market, the projected costs for recovery from this oil shale has remained higher than the costs of purchasing the oil in the world market.

The present invention is applicable to oil shales having varied amounts of oil content and covered by overburden. It can be applied to oil shales without recoverable valuable mineral content other than oil. It can also be applied to oil shales containing other minerals, where the recovery of those minerals is to be accomplished separately or where their recovery is not desired.

An object of this invention is to provide an economical process for producing oil from oil shale deposits.

The prior-art process of above-ground retorting comprises mining the oil shale, crushing the oil shale, heating the crushed shale in large ovens or retorts, recovering its petroleum values, cooling the spent shale, and finally disposing of the retorted spent shale residue.

It has been proposed to mine the oil shale by excavating large underground cavities or rooms, leaving supporting columns or pillars of shale between the rooms. Since, in this room-and-pillar method, the pillars must remain forever underground, their mineral values cannot be utilized, and only about 55–75% of the shale of the total shale present could be mined, leaving a loss of 30–45% of the shale, along with its oil and mineral content.

It has also been proposed to employ pit mining, first removing or stripping off the overburden and then mining the oil shale. Tremendous land scars result from this process, for the pits would be several thousand feet in diameter and up to three thousand feet deep. Current estimates are that open pit mining would become economical in the foreseeable future only for shales containing over twenty gallons per ton of oil.

In both pit mining and room-and-pillar mining, the shale would have to be transported, crushed, and screened. These process steps would be quite expensive and would consume large amounts of energy. Moreover, the construction and operation of above-ground retorts is expensive. Still further, the residue of the retorting, the spent shale, has to be disposed of. The quantity of this residue, depending on the oil content of the shale, is approximately 80–90% of the weight of the mined shale.

For example, for a plant to produce one-million-barrels of petroleum per day, the quantity of the shale which would have to be retorted (assuming 100% recovery of the oil, and even assuming 30 gallons of oil per ton of shale) would be 1.4 million tons per day or 511 million tons per year. Mining these quantities of shale for above-ground processing would necessitate an approximate doubling of the total current undergound mining capacity of the U.S.A. Moreover, the residue, or spent shale, which in this example would be approximately 85% by weight of the shale, would be 1.19 million tons per day and 434 million tons per year. The disposal of such quantities would cause considerable problems. Moreover, not only is the space requirement very high, but there is a danger that the water-soluble mineral content of the spent shale would be leached out by rain and would contaminate the surface and subterranean waters.

SUMMARY OF THE INVENTION

In the present invention, both room-and-pillar mining and open-pit mining are dispensed with, and the need to transport large quantities of shale is eliminated. By eliminating these expenses, shale with lower kerogen (or oil) content can be processed more economically.

In this invention, the retorted and extracted residue remains underground, so that no residue has to be disposed of aboveground. The landscape is not scarred. Also, the crushing and screening of large quantities of shale is eliminated, and there is no need to build, maintain, and operate large aboveground retorts.

The invention employs four basic steps, preferably followed by an additional step; all of which are conducted underground.

Step 1. Drilling wells

Drilling both injection wells and recovery wells into the formation, preferably in a pattern of hexagons joined like honeycomb.

Step 2. Retorting

Thermally decomposing the oil-bearing compound, e.g., kerogen, of oil shale into oil vapors, combustible gases, and carbon residue, then conducting the oil vapors and combustible gases to aboveground.

Step 3. Combustion

Burning the carbon residue underground in a manner such that carbon monoxide is produced in quantity and the temperature of the formation remains lower than the softening temperature of the spent shale. The softening temperature depends on the composition of the particular oil shale deposit. The carbon monoxide is recovered aboveground. At the same time, alkaline earth carbonates are converted into oxides.

Step 4. Steam generation

Injecting water, in the form of liquid, vapor, mist, or steam into the hot formation and recovering high temperature steam. Some of the alkaline earth oxides are converted into hydroxides.

Step 5. Purifying the flue or exhaust gases and restoring the spent, burned shale formation Pumping the exhaust or flue gases from the operation through the spent shale formation. Sulfur oxides and carbon dioxide react with the alkaline oxides and hydroxides, thereby removing these gases and restoring approximately the original carbonate content of the formation.

DETAILED DESCRIPTION OF THE FIRST-OUTLINED PROCESS ABOVE

Step 1. Drilling wells

The oil shale deposits usually lie up to several hundred feet below ground. Above ground, at a suitable location, the process equipment is set in place.

Figure 1:
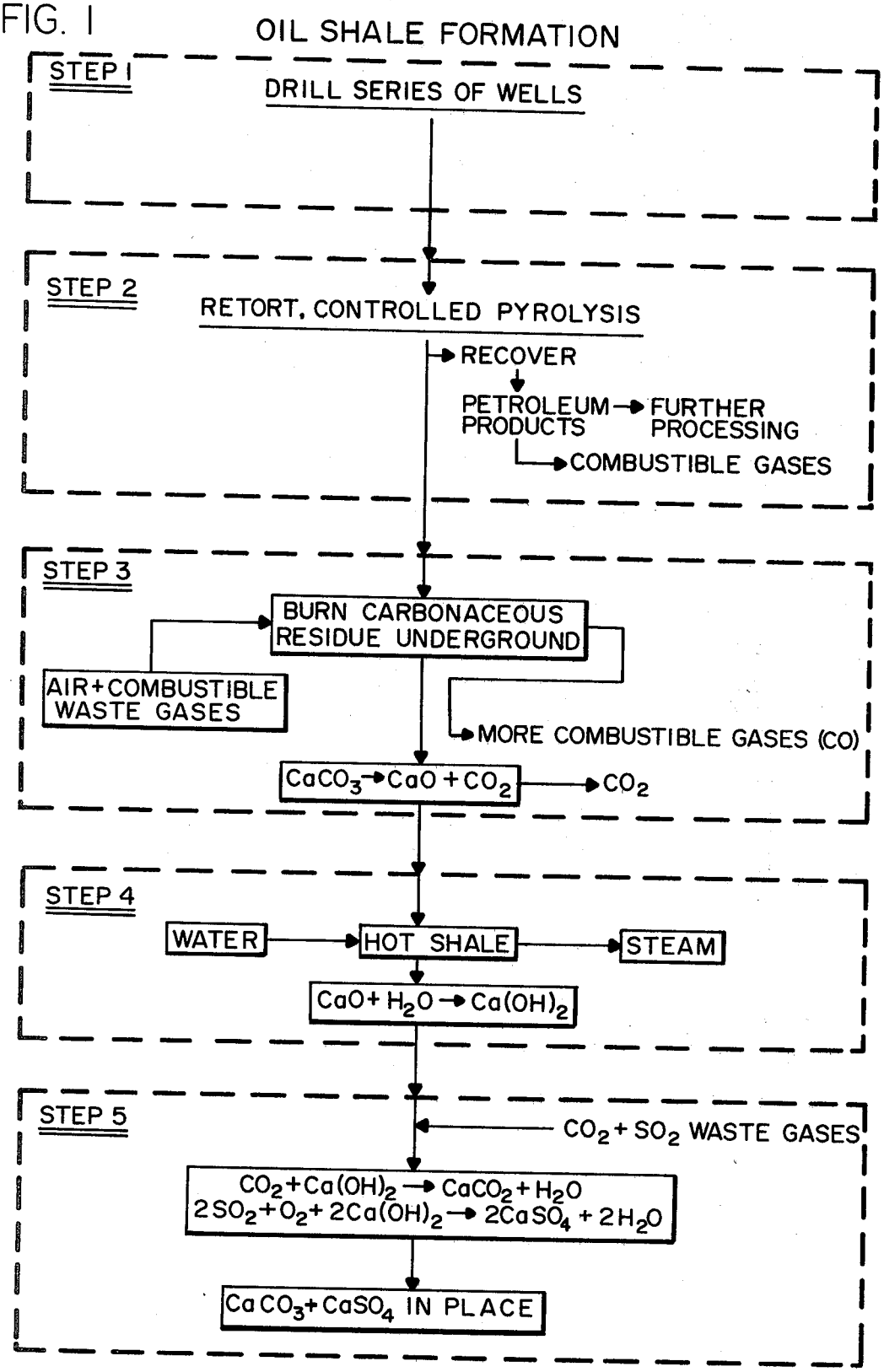
FIG. 1 is a key diagram flow sheet of an embodiment of the principles of the invention.
Figure 2:
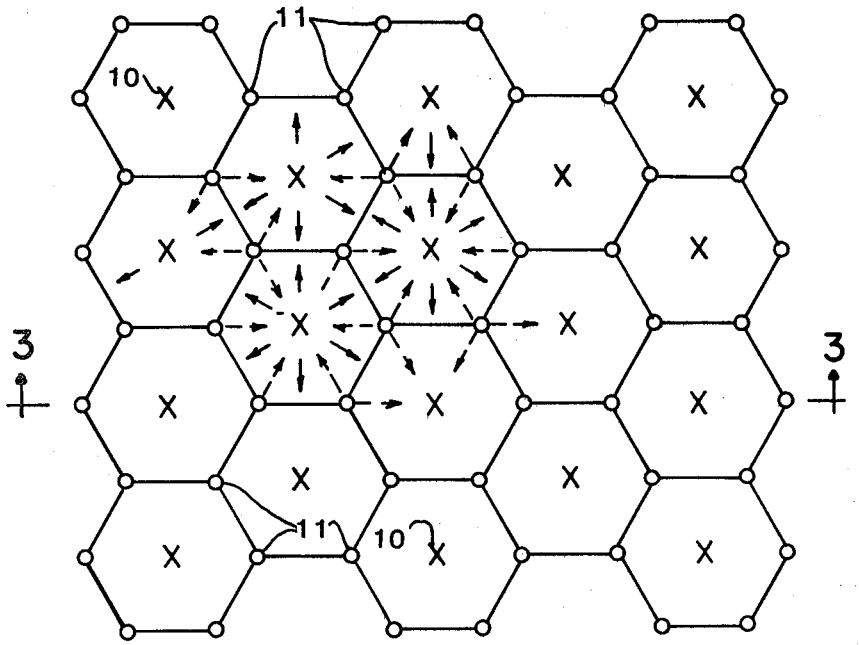
FIG. 2 is a diagrammatic view of a configuration of wells for injection and recovery of gases and liquids; as well as for retorting and recovery of the shale oil.

The process actually begins with the drilling of wells, Step 1 in FIG. 1, preferably in a continuous hexagonal pattern as shown in FIG. 2. The wells penetrate through the overburden into the oil shale formation. Wells 10 at the center of the hexagons are the injection wells, and the six wells 11 immediately surrounding them are the recovery wells. This pattern comprises a number of adjacent identical hexagons. In each hexagon all six sides are common with sides of the adjacent six hexagons, and the recovery wells 11 at the vertices of the hexagons are shared by the three adjoining hexagons having a common vertex. At the center of each hexagon there is an injection well 10.

Figure 3:
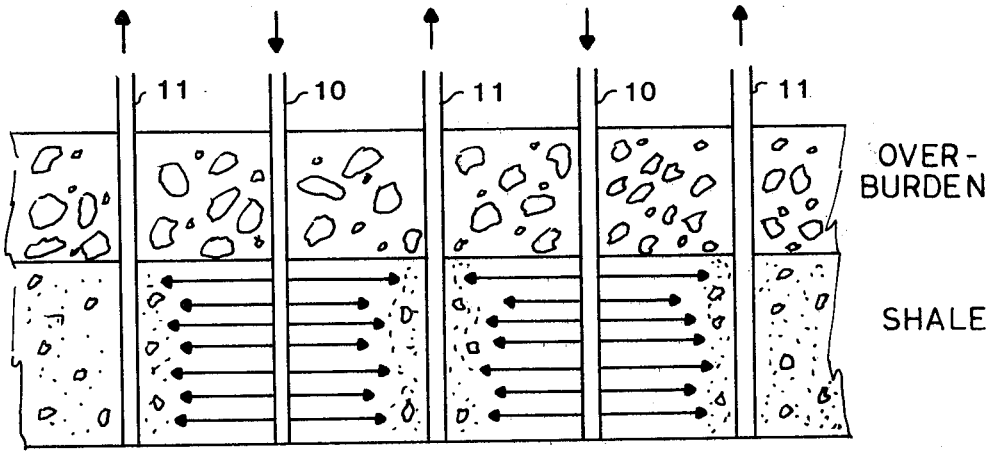
FIG. 3 is a diagrammatic view in section taken along the line 3—3 in FIG. 2.

The oil shale formation 12 (see FIG. 3) should have adequate porosity and permeability, so that the gases and vapors can pass between the injection wells 10 and the recovery wells 11. If natural porosity and permeability are absent, communications between the wells 10 and 11 must be established. This can be accomplished by well known fracturing methods; e.g., by explosives, by fluids, or by drilling and blasting between the wells in the shale formation or by a combination of methods. For example, charges in two or more wells may be exploded simultaneously to form intersecting fractures which provide the communication between the wells. Alternatively, hydraulic fracturing may be employed simultaneously at two or more wells. In both cases, the fractures maintain their width at the intersection, instead of restricting the open path as in the case with the customary consecutive fracturing.

The permeability of the formation can be increased at any stage of the operation by using an explosive gas mixture for fracturing or enlarging fissures. The composition of the gases should be within the explosive limits of the gas mixture used. The gas mixture, comprising a combustible gas and an oxidant (oxygen, oxygen enriched air, or air) is injected into the formation through one or more wells.

Step 2. Retorting

The oil shale 12 is ignited at the recovery wells 11, while the oxidizing gases, which can be oxygen, air, a combination of air and oxygen, or a combination of either or both with other gases, are supplied through the injection wells 10.

The temperature of retorting is maintained within a temperature range of approximately 600° to 1100° F. This temperature is maintained by regulating the rate of flow and the composition of the gases. As needed, combustible gases or non-combustible gases or steam can be added to the oxidizing gases to maintain the desired temperature.

During the retorting process, part of the oil-bearing component of the oil shale 12 is burned to provide heat for the increase of the temperature of the formation and to provide the heat needed for the retorting process itself. The projects of thermal decomposition are: oil vapors, combustible gases and carbon residue. The vapors and gases are collected above ground, cooled, condensed, and stored or processed further.

Step 3. Combustion

During the retorting in Step 2, as the oil bearing component of the oil shale 12 thermally decomposes, the volatile products are removed. Another product of decomposition is carbon, which remains on the spent shale in a dispersed state. The temperature of the formation is essentially the same as it was at the end of the retorting, namely, between 600° F. and 1100° F.

In Step 3 air is pumped into the hot formation through the injection wells 10, and the dispersed carbon is burned. The heat of combustion further increases the temperature of the remaining spent burned shale.

This combustion is conducted in such a way that the temperature is kept lower than the softening temperature of the formation. Regulation of the temperature is achieved by conducting the burning in such a manner that the product of the combustion of carbon is partly or entirely carbon monoxide (CO) gas, which is recovered through the recovery wells 11. The carbon-to-carbon-monoxide reaction produces much less heat than the carbon-to-carbon-dioxide reaction. Because less heat is transferred to the spent, burned shale formation, its temperature is kept lower.

Further adjustment of the temperature may be achieved by the injection of non-combustible gases, water vapor, water mist, steam, or a combination of them.

At the end of the combustion step, the temperature of the formation is approximately between 1500° F. and 1900° F. In this temperature range the carbon-to-carbon-monoxide reaction is predominant, and this temperature is below the softening temperature of the spent and burned residue of most oil shale formations.

Some of the waste combustible gases which are generated at various stages of the operation may be burned underground in this step.

In this step some of the minerals present in the spent oil shale matrix undergo thermal decomposition. For example, calcium carbonate, $CaCO_3$ decomposes to $CO_2$ gas and calcium oxide, CaO. Similarly, $MgCO_3$ decomposes to $CO_2$ gas and to MgO.

Step 4. Steam generation

After burning is completed, in order to produce high temperature steam, the hot formation is then contacted with water. Water, in the form of liquid, vapor, mist or steam is injected through the injection wells, and high temperature steam is recovered through the recovery wells.

When steam is used in injection, it may be obtained by utilizing the heat of some of the waste gases to produce said steam and/or by injecting low temperature and pressure steam discharged by the power plant and processing plant.

An alternative method of producing steam for injection is generating it in downhole steam generators. In this case electricity, combustible gases, or some of the byproduct combustible gases are utilized in the downhole generators to provide the heat for the generation of steam.

The steam generated in this step may be used in the power plant for generating electricity or may be used in the process as a source of heat.

In this step, some of the compounds formed in Step 3 are hydrated, or partially hydrated. For example, calcium oxide, CaO, reacts with water to form calcium hydroxide, $Ca(OH)_2$.

When the steam produced underground is superheated, it can be converted to steam which is saturated or can remain superheated to a lower degree by injecting a calculated amount of water, water mist, or spray, supersaturated steam, or a mixture or combination of them into the flow of superheated steam generated in the hot spent burned formation.

Step 5. Purifying the flue or exhaust gases and restoring the spent burned shale formation The excess alkaline earth oxides and hydroxides react with the $CO_2$ content of the raw flue gases to form the carbonates $CaCO_3$, $MgCO_3$, etc., which were original components of the oil shale deposit.

Part of the original sulphur content of the oil shale is in the flue gases, primarily as $SO_2$ gas. This $SO_2$ (and possibly some $SO_3$) reacts with oxygen, the metal oxides, and hydroxides, forming eventually $CaSO_4$ which in the form of gypsum and anhydrite occurs in nature in large quantities. There may be some formation of sulfites. The sulphur content and part of the carbon dioxide content of the flue gases is removed in this step, thereby essentially eliminating the emission of sulfur oxides and greatly reducing the emission of carbon dioxide into the atmosphere.

This Step 5 is optional, for it has no influence on the oil recovery and steam generation. Its purpose is to purify the discharge gases and strengthen the residual formation by partially or completely restoring is original carbonate content.

To those skilled in the art to which this invention relates, many changes in construction and widely differing embodiments and application of the invention will suggest themselves without departing from the spirit and scope of the invention. The disclosures and the descriptions herein are purely illustrative and are not intended to be in any sense limiting.

I claim:

1. A method for in situ recovery of oil from oil shale containing kerogen, comprising:

thermally decomposing the kerogen underground to produce oil vapors, combustible gases, and solid carbon residue at a temperature below about 1100° F., conducting the oil vapors and combustible gases to aboveground and recovering them there, while leaving the solid carbon residue below ground, only after completing the recovering of the oil vapors and combustible gases at a given portion of a site, burning the solid carbon residue at that portion of the site underground at a controlled rate such that the temperature of the formation rises to about 1500° to 1900° F. but remains below the softening temperature of the spent shale and at controlled oxidation, so that carbon monoxide is produced, conducting the gases containing carbon monoxide aboveground and recovering the carbon monoxide there, injecting water into the hot formation at that portion of the site only after the burning step is completed at that portion of the site to produce steam at high temperature, and conducting the high temperature steam aboveground and recovering its heat values there.

2. The method of claim 1 followed, after conclusion of the last named step at the given portion of the site, by returning exhaust gases containing carbon dioxide and sulfur oxides into the formation and reacting them there with the alkaline earth oxides and hydroxides then in the formation to produce carbonates and sulfates, thereby stabilizing the formation and strengthening it and purifying the gases by removing their sulphur oxide content and part of their carbon dioxide content.

3. The method of claim 1 or claim 2, wherein:

said thermally decomposing step is preceded by the step of drilling a series of recovery wells into said oil shale in a pattern wherein each well is at the vertex of a substantially regular hexagon and drilling a series of injection wells, one at the center of each said hexagon, in said thermally decomposing and burning step, injecting oxygen containing gas into said injection wells and igniting some of said shale, injecting the water in said injecting step in said injection wells, recovering said oil vapors and combustible gases, together with said carbon dioxide, and said steam in the successive said conducting steps, via said recovery wells.

4. The method of claim 3 wherein the igniting of the oil shale is done at said recovery wells.

5. The method of claim 1 wherein the formation is fractured between injection wells and recovery wells to provide passage for gases therebetween.

6. The method of claim 5 comprising simultaneous fracturing at a plurality of said wells.

7. The method of claim 6 wherein the fracturing is explosive fracturing.

8. The method of claim 6 wherein the fracturing is fluid fracturing.

9. A method for obtaining useful products from an oil shale formation, comprising the following steps:

(1) drilling a series of wells into said formation from above ground, (2) opening and maintaining generally vertical passageways between wells in the shale formation, (3) retorting the shale in situ with controlled pyrolysis by (a) sending air down through some of said wells, as injection wells and injecting it into said passageways, (b) igniting the shale at the adjacent other said recovery wells, (c) burning the shale with the combustion front progressing generally horizontally from the recovery wells toward the injection wells, and (d) recovering vaporized petroleum products through said other wells as recovery wells, leaving in place unburned carbon residue and other non-volatile shale ingredients, (4) only after completion of steps 1–3 at some said wells, burning the carbon residue there in situ under controlled conditions while (a) sending air down through said injection wells at a controlled rate,
(b) controlling the burning and air injection to produce a substantial amount of carbon monoxide,
(c) recovering the carbon monoxide through said recovery wells,
(d) preventing softening of the remaining formation, and
(e) decomposing alkaline earth carbonates in said formation into alkaline earth oxides, and (5) soon after, but only after completing said burning step at said some wells, injecting water into said injection wells, thereby
(a) producing steam at high temperatures,
(b) recovering high-temperature steam through said recovery wells, and
(c) reacting some of said steam with some of said alkaline earth oxides to produce some alkaline earth hydroxides.

10. The method of claim 9 wherein said water in step (5) is steam produced in downhole steam generators.

11. The method of claim 9 followed after completion of steps 1–5, by injecting waste gases containing carbon dioxide and sulfur oxides into said injection wells, thereby
(a) reacting said alkaline earth oxides and hydroxides to produce carbonates, sulfites, and sulfates, and thereby
(b) strengthening said formation and
(c) purifying said injected gases.

12. The method of claim 9 wherein the retorting is done at approximately 600° F. to 1100° F.

13. The method of claim 9 wherein the burning is done to keep the formation at approximately 1500° F. to 1900° F.

14. A method for obtaining useful products from an oil shale formation, comprising the following steps:

(1) drilling a series of wells into said formation from above ground in a hexagonal pattern with recovery wells at the vertices and drilling injection wells, one at the center of each hexagon, (2) opening passageways between wells in the shale formation, (3) retorting the shale in situ with controlled pyrolysis at approximately 600° F. to 1100° F., by
(a) sending air down through said injection wells and injecting it into said passageways,
(b) igniting the shale adjacent to said recovery wells,
(c) burning the shale with the combustion front progressing from the recovery wells toward the injection wells, and
(d) recovering vaporized petroleum products through said recovery wells, leaving in place carbon residue and other nonvolatile shape ingredients including alkaline earth carbonates, (4) only after completion of steps 1–3 at some said wells burning the carbon residue adjacent said wells in situ under controlled conditions, while
(a) sending air down through those said injection wells at a controlled rate,
(b) controlling the burning the air injection to produce a substantial amount of carbon monoxide,
(c) recovering the carbon monoxide through those said recovery wells,
(d) preventing softening of the remaining formation by holding the temperature of the formation between 1500° F. and 1900° F., and
(e) decomposing the alkaline earth carbonates into alkaline earth oxides, (5) soon after, but only after, completing said burning step at those said wells, injecting water into said injection wells, thereby
(a) producing steam at high temperatures
(b) recovering high-temperature steam through those said recovery wells, and
(c) reacting some of said steam with some of said alkaline earth oxides to produce some alkaline earth hydroxides, and (6) injecting waste gases containing carbon dioxide and sulfur oxides into those said injection wells, thereby
(a) reacting said alkaline earth oxides and hydroxides to produce carbonates, sulfites, and sulfates, and, thereby,
(b) strengthening said formation and
(c) purifying said injected gases.

15. The method of claim 14 wherein the water in step (5) is in the form of steam.

* * * * *

UNITED STATES PATENT AND TRADEMARK OFFICE

CERTIFICATE OF CORRECTION

PATENT NO. : 4,444,258

DATED : April 24, 1984

INVENTOR(S) : Nicholas Kalmar

It is certified that error appears in the above-identified patent and that said Letters Patent are hereby corrected as shown below:

Column 1, line 19, "suifficient" should read --sufficient--.

Column 5, line 41, "restoring is" should read --restoring its--.

Column 8, line 12, "shape" should read --shale--.

Signed and Sealed this

*Fourteenth* Day of *August 1984*

[SEAL]

*Attest:*

GERALD J. MOSSINGHOFF

*Attesting Officer*

*Commissioner of Patents and Trademarks*